United States Patent [19]

Weldon

[11] Patent Number: 4,840,107

[45] Date of Patent: Jun. 20, 1989

[54] METHOD AND APPARATUS FOR MANAGING RECOIL OF ELECTROMAGNETIC GUNS

[75] Inventor: William F. Weldon, Austin, Tex.

[73] Assignee: Board of Regents, The University of Texas System, Austin, Tex.

[21] Appl. No.: 39,655

[22] Filed: Apr. 16, 1987

[51] Int. Cl.[4] ..... F41F 1/02

[52] U.S. Cl. ..... 89/8; 89/42.01; 89/40.04; 124/3

[58] Field of Search ..... 89/8, 14.05, 42.01, 89/191.01; 124/3

[56] References Cited

U.S. PATENT DOCUMENTS

| | | | |
|---|---|---|---|
| 3,279,320 | 10/1966 | Rosebrock | 89/8 |
| 4,200,831 | 4/1980 | Weldon et al. | 310/266 |
| 4,527,457 | 7/1985 | Fikse | 89/8 |
| 4,572,964 | 2/1986 | Honig | 307/106 |

OTHER PUBLICATIONS

F. W. Sears, Mechanics, Heat and Sound, 1950, pp. 231–235.

Popular Mechanics, Jun. 1985, p. 136.

Pratap et al., "A Compulsator Driven Rapid-Fire EM Gun," IEEE Transations on Magnetics, vol. 20, No. 2, Mar. 1984, pp. 211–214.

"Armament Concepts Office Stresses 'New Ideas'", Army Research, Development & Acquisition Magazine, Jan–Feb. 1980, pp. 18–19.

*Primary Examiner*—Stephen C. Bentley

*Attorney, Agent, or Firm*—Arnold, White & Durkee

[57] ABSTRACT

A power supply generating a reaction torque generally simultaneously with its power output is utilized to supply power to fire the railgun. The power supply and the railgun are cooperatively mounted together such that the reaction torque of the power supply upon discharge counteracts the recoil force of the railgun, thereby transferring lateral forces through the compulsator to a position in the power supply which is removed from the position of the coupling between the railgun and the power supply.

7 Claims, 1 Drawing Sheet

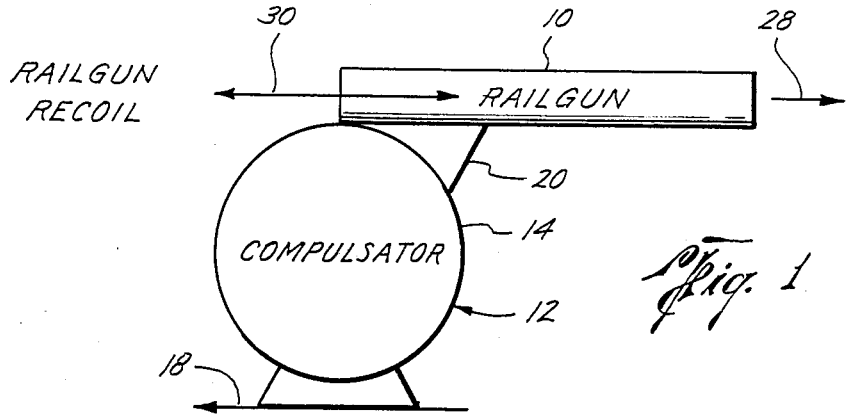
Fig. 1
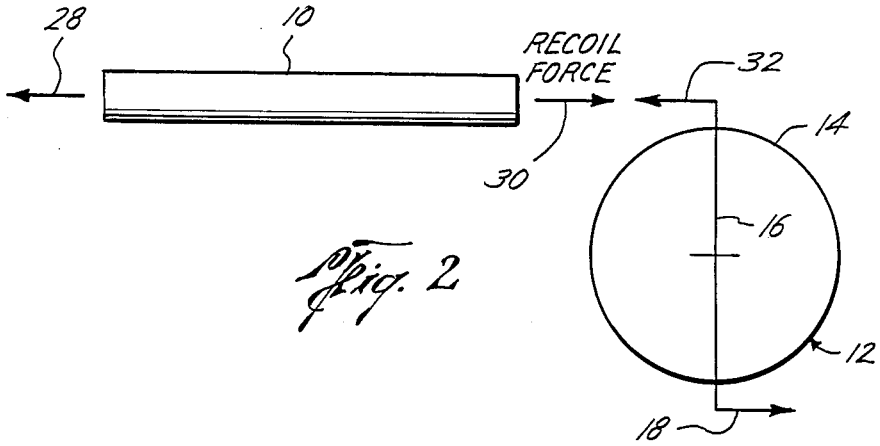
Fig. 2
Fig. 3
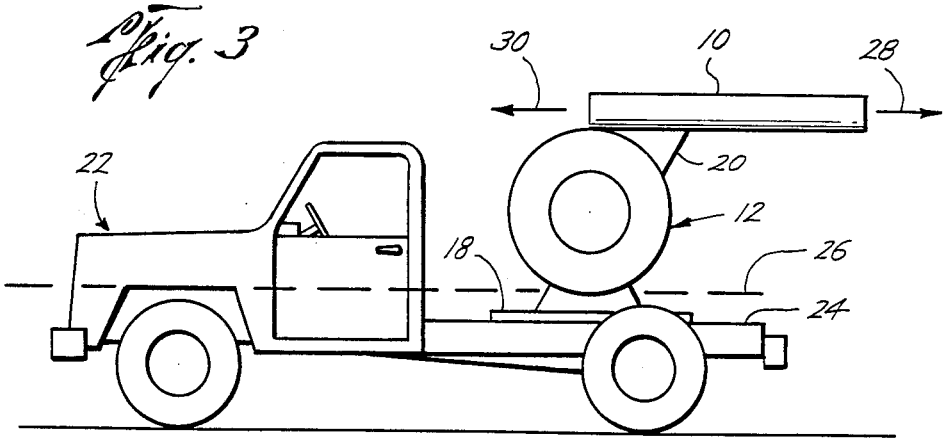

METHOD AND APPARATUS FOR MANAGING RECOIL OF ELECTROMAGNETIC GUNS

BACKGROUND OF THE INVENTION

The present invention relates generally to electromagnetic railguns, and more specifically relates to methods and apparatus for managing recoil of electromagnetic railguns, which methods and apparatus are particularly advantageous when the railgun is on a platform or is carried on a vehicle.

Gun recoil is a well known phenomena associated with projectile-firing mechanisms of all types. Although usually thought of in connection with gas pressure, or thermodynamic, guns, the recoil phenomenon is present in electromagnetic guns, i.e., railguns. The force which propels the projectile down the barrel of the gun also causes the gun to recoil in an opposite direction. Recoil is a significant problem with large high-powered guns mounted on vehicles, such as trucks or armored carriers. The guns are typically mounted as high as possible on the vehicle to facilitate access and "vision" of the gun. The axis of the gun (i.e., the barrel), is therefore typically significantly above the center of gravity of the vehicle or other platform. Accordingly, recoil of the gun will typically manifest itself as an overturning moment on the vehicle. In many cases, this overturning moment places a limit on the size or power of the gun which may be mounted on a particular vehicle.

Several techniques have been proposed for attempting to manage recoil. For example, U.S. Pat. No. 4,527,457, issued July 9, 1985 to Fikse, discloses an embodiment of a railgun wherein a mechanicam is provided in the railgun to generate a reaction force which is substantially equivalent to, but in the opposite direction of, the recoil force. Fikse suggests the use of a second pair of generally parallel conductors, which are responsive to the same current utilized to fire the projectile from the railgun. This second pair of conductors is utilized to accelerate a recoil mass in a closed system to generate the reaction force. Fikse also suggests the use of an exhaust jet having an expansion chamber and a nozzle whereby the hot gases associated with the forming of the plasma which accelerates the projectile down the railgun will pass through the nozzle to generate the reaction force. As will be readily recognized, the proposals of Fikse are extremely inefficient in that they require a dramatic energy increase in the system to compensate for the railgun recoil.

Other proposed systems for managing railgun recoil have included varying the conformity of the rails of the railgun itself in an attempt to redistribute the recoil direction. However, such proposed techniques have imposed substantial limitations on the performance of the railgun.

Accordingly, the present invention provides a new method and apparatus for managing recoil in electromagnetic railguns by utilizing a power source for firing the railgun which is cooperatively coupled to the railgun and which is adapted to generate a force similar to, and opposing, the railgun recoil force. Such coupling arrangement redistributes the recoil force to lower the overturning moment of the assembly.

SUMMARY OF THE INVENTION

The present invention includes the cooperative use of a railgun and a power supply for that railgun, which power supply, at the time of discharge, exhibits a reaction torque in the stator. In a preferred embodiment, the power supply will be a compensated pulsed alternator power supply, also known as a "compulsator". Also in a preferred embodiment, the railgun is rigidly secured to the stator of the power source such that at the time the railgun is actuated, and both the projectile force and the recoil force are generated, the reaction torque will be generated in the power supply stator, and will effectively transfer the recoil force through the diameter of the power supply. This transfer reduces the overturning moment on any platform upon which the power supply and railgun are mounted.

BRIEF DESCRIPTION OF THE DRAWINGS

FIG. 1 schematically depicts a railgun coupled to a power supply in accordance with the present invention.

FIG. 2 schematically depicts the forces generated at the time of firing a railgun established in accordance with the present invention.

FIG. 3 schematically depicts a vehicle having a power supply and railgun coupled thereto in accordance with the present invention.

DETAILED DESCRIPTION OF A PREFERRED EMBODIMENT

Referring now to the drawings in more detail, and particularly to FIG. 1, therein is schematically depicted an electromagnetic railgun 10 cooperatively coupled to a compulsator power supply 12, in accordance with the present invention. Railgun 10 can be of any type known to the art, such as, for example, a parallel rail railgun or a coaxial railgun. Compulsator power supply 12 will preferably be a device constructed in accordance with U.S. Pat. No. 4,200,831 issued Apr. 29, 1980 to Weldon, et al. The disclosure of U.S. Pat. No. 4,200,831 is hereby incorporated herein by reference.

Briefly, compulsator 12 is an alternator specially adapted to produce short duration, high power pulses of electrical power. The rotor of the compulsator is driven by an appropriate device for the particular application in question, such as, for example, a gas turbine. Once the compulsator rotor is driven to design speed, an external switch is closed at the appropriate time to produce a half sinusoidal pulse, or a fraction thereof, to provide the desired output current to the railgun. As will be apparent from the discussion to follow, although compulsators have been proposed for use which have two rotors rotating in opposite directions, so as to minimize the reaction torque at the time of discharge, such designs would not be optimal for use with the present invention.

At the time the power is extracted from compulsator 12, the mechanical power extracted from the rotor is equal to the electrical power generated, i.e.:

$$T\omega = VI,$$

where;

T=torque;

$\omega$=angular velocity;

V=generated (open circuit) voltage; and

I=the output current of the compulsator.

For a single rotor compulsator, at the time the power is extracted from the rotor, the torque (T) is applied to the compulsator stator as a reaction torque which manifests itself as a reaction force at the periphery of the compulsator stator. The extracted electrical current (I)

is delivered to the railgun and is the source of the force on the projectile:

$$F=\frac{1}{2}L'I^2$$

where

F = the force on the railgun projectile; and

L' = the inductance gradient of the railgun.

Therefore, discounting losses in the system, the compulsator output power matches the railgun input power (the power to the projectile). Additionally, again discounting losses in the system, such as friction losses, the recoil force of the railgun will be proportional to the input power of the railgun. Accordingly, the recoil force of the railgun will be generally proportional to the reaction torque on the compulsator stator. Accordingly, even allowing for losses in the system, a functional relation exists between the projectile force, the recoil force, and the reaction torque and reaction force of the compulsator.

Referring now also to FIG. 2, by solidly mounting railgun 10 to an upper portion of stator 14 of compulsator 12, the recoil of railgun 10 can be effectively transferred through the diameter 16 of compulsator stator 14 to a plane 18 intersecting the lower extreme of compulsator stator 14, or another member securely affixed thereto, by allowing it to react against the discharge torque of the compulsator.

The physical construction of railgun 10 and of compulsator 12 (and particularly of compulsator stator 14), as well as the physical coupling of the two, may be accomplished in accordance with conventional principles of mechanical engineering. Clearly, however, compulsator stator 14 will be designed to withstand the impinging forces of the compulsator reaction torque and the railgun recoil. Similarly, coupling 20 between railgun 10 and stator 14 will be adapted to withstand the above forces without damage.

Referring now also to FIG. 3, therein is schematically depicted a vehicle 22, such as a truck, with a compulsator 12 and a railgun 10 attached thereto in accordance with the present invention. Railgun 10 and compulsator 12 are mounted on the bed 24 of truck 22. In accordance with the preferred design considerations set forth earlier herein, railgun 10 is located in a relatively high position for access and for gun "vision". Yet, as can be seen from a comparison of FIG. 2 and FIG. 3, the lateral force representing the overturning moment is transferred through compulsator 12 to plane 18 located beneath the center of gravity 26 of truck 22.

As can be seen from FIG. 3, the force propelling the projectile out of railgun 10, along line 28, generates an opposite recoil force along line 30. Railgun 10 is appropriately mounted to compulsator 12 relative to the rotation of compulsator 12 such that at the time electrical current is withdrawn from compulsator 12 and applied to railgun 10, thereby generating the projectile force and the recoil force, the reaction force 32 on compulsator stator 14 (in the opposite direction of the rotor rotation) proximate the axis of railgun 10 is directed in the direction of projectile force along line 28. As will be recognized by those skilled in the art, the reaction force 32 on compulsator stator 14 is a rotational moment around the compulsator rotor. Accordingly, 180 degrees from a reaction force vector along the barrel of railgun 10, (along line 30) is a reaction force vector in the opposite direction along plane 18. However, as noted above, the opposite reaction force vector along plane 18 is situated beneath center of gravity 26 of truck 22.

Those skilled in the art will recognize that many modifications and variations may be made in the techniques and structures described and illustrated herein without departing from the spirit and scope of the present invention. Accordingly, it should be readily understood that the foregoing description and drawings are illustrative only and are not to be considered as limitations upon the present invention.

We claim:

1. A method of distributing recoil force of a railgun, comprising:

establishing a power supply for said railgun, which power supply exhibits a reaction force vector acting on said power supply in a component at the time of power discharge;

coupling said railgun to said power supply such that a railgun recoil force arising as a result of firing of said railgun will oppose the reaction force vector of the power supply component along the axis of the railgun.

2. The method of claim 1, wherein said power supply comprises a compensated pulsed alternator.

3. The method of claim 1, wherein said power supply includes a stator, and wherein said railgun is coupled to said stator.

4. The method of claim 1, wherein said power supply includes a stator, and wherein said railgun is rigidly coupled to said stator.

5. A method of managing the recoil force of an electromagnetic gun, comprising:

establishing a power supply for said electromagnetic gun, said power supply having a rotor and a stator and exhibiting a reaction force in said stator at the time said power supply is discharged;

coupling said electromagnetic gun to said stator in such a position that said recoil force will impinge said reaction force in said stator at the time said power supply is discharged and said electromagnetic gun is fired.

6. The method of claim 5, wherein said power supply is a compensated pulsed alternator.

7. The method of claim 5, wherein said electromagnetic gun is rigidly coupled to said stator.

* * * * *